US007204484B2

(12) United States Patent
Motamed

(10) Patent No.: US 7,204,484 B2
(45) **Date of Patent: *Apr. 17, 2007**

(54) SIMPLE AND INEXPENSIVE HIGH-CAPACITY OUTPUT CATCH TRAY FOR DOCUMENT PRODUCTION MACHINES

(75) Inventor: Margaret Motamed, Foster City, CA (US)

(73) Assignee: Electronics for Imaging, Inc., Foster City, CA (US)

( * ) Notice: Subject to any disclaimer, the term of this patent is extended or adjusted under 35 U.S.C. 154(b) by 6 days.

This patent is subject to a terminal disclaimer.

(21) Appl. No.: 10/983,431

(22) Filed: Nov. 8, 2004

(65) Prior Publication Data

US 2005/0062221 A1 Mar. 24, 2005

Related U.S. Application Data

(63) Continuation of application No. 10/404,942, filed on Mar. 31, 2003, now Pat. No. 6,832,865, which is a continuation of application No. 09/661,968, filed on Sep. 14, 2000, now Pat. No. 6,572,293.

(51) Int. Cl.
*B41J 13/10* (2006.01)

(52) U.S. Cl. ..... 271/219; 400/647

(58) Field of Classification Search ..... 211/50, 211/51; 312/50, 61, 71; 271/219, 214, 213, 271/224, 215, 217, 218; 270/58.13, 58.28; 400/647, 647.1

See application file for complete search history.

(56) References Cited

U.S. PATENT DOCUMENTS

| | | | | |
|---|---|---|---|---|
| 1,694,638 A | | 12/1928 | Borrowdale | |
| 1,928,923 A | | 10/1933 | Andersen | |
| 3,046,010 A | | 7/1962 | Schneider | |
| 3,137,499 A | * | 6/1964 | Maidment | 271/185 |
| 3,149,836 A | | 9/1964 | Ragozzoni et al. | |
| 3,655,186 A | * | 4/1972 | Bayha | 271/180 |
| 3,889,824 A | | 6/1975 | Wood | |
| 3,907,281 A | * | 9/1975 | McKenzie | 271/219 |
| 4,310,160 A | | 1/1982 | Willette et al. | |
| 4,329,046 A | | 5/1982 | Burkett et al. | |
| 4,357,127 A | * | 11/1982 | Kooiman | 312/71 |
| 4,624,452 A | | 11/1986 | Pulskamp | |
| 4,667,953 A | | 5/1987 | Hirakawa et al. | |

(Continued)

FOREIGN PATENT DOCUMENTS

DE 4020730 A1 1/1992

(Continued)

OTHER PUBLICATIONS

E.A. Mazzarelli et al., "Paper Stacker," IBM Technical Disclosure Bulletin, p. 1125, Aug. 1980.

*Primary Examiner*—Patrick Mackey
*Assistant Examiner*—Kaitlin Joerger
(74) *Attorney, Agent, or Firm*—James Trosino

(57) ABSTRACT

The invention is relates to a simple, inexpensive high capacity output catch tray for copiers and other document production machines. The output tray automatically increases in capacity as the stack of copies in it accumulates, without external power source or control, while maintaining a relatively constant elevation relative to the copier output port, and automatically returns to its original position when partially or completely unloaded.

4 Claims, 6 Drawing Sheets

U.S. PATENT DOCUMENTS 4,718,657 A 1/1988 Otter et al.
4,946,152 A 8/1990 Ishikawa et al.
4,980,780 A 12/1990 Tanaka
4,989,853 A 2/1991 Matysek et al.
4,990,967 A 2/1991 Colglazier et al.
5,048,983 A 9/1991 Fukae
5,126,786 A 6/1992 Tanaka
5,253,757 A * 10/1993 Locker ..... 206/449
5,273,274 A 12/1993 Thomson et al.
5,284,336 A 2/1994 Ricciardi
5,305,996 A * 4/1994 Taniwa et al. ..... 271/22
5,318,401 A 6/1994 Mandel
5,332,210 A 7/1994 Silverberg et al.
5,346,203 A 9/1994 Stemmle
5,431,530 A 7/1995 Kobayashi et al.
5,547,178 A 8/1996 Costello
5,551,686 A 9/1996 Sanchez et al.
5,594,536 A 1/1997 Kawabata et al.
5,599,009 A 2/1997 Mandel et al.
5,603,492 A 2/1997 Mandel et al.
5,609,333 A 3/1997 Mandel et al.
5,628,042 A 5/1997 Less
5,697,761 A 12/1997 Morgan et al.
5,704,609 A 1/1998 Mandel et al.
5,823,529 A 10/1998 Mandel et al.
5,832,358 A 11/1998 Sampath et al.
5,884,123 A 3/1999 Stickney et al.
5,924,808 A 7/1999 Sides, II
6,000,770 A * 12/1999 Frich ..... 312/319.7
6,035,973 A * 3/2000 Neal et al. ..... 187/244
6,206,365 B1 3/2001 Nanba et al.
6,572,293 B1 * 6/2003 Motamed ..... 400/647
6,832,865 B2 * 12/2004 Motamed ..... 400/647

FOREIGN PATENT DOCUMENTS

DE 19907444 A1 9/1999
EP 0768264 A1 4/1997
EP 0768266 A1 4/1997
GB 494101 10/1938

* cited by examiner

SIMPLE AND INEXPENSIVE HIGH-CAPACITY OUTPUT CATCH TRAY FOR DOCUMENT PRODUCTION MACHINES

REFERENCE TO RELATED APPLICATIONS

This application is a continuation of U.S. application Ser. No. 10/404,942, filed 31 Mar. 2003, now U.S. Pat. No. 6,832,865, which is a continuation of U.S. application Ser. No. 09/661,968, filed 14 Sep. 2000, now U.S. Pat. No. 6,572,293.

FIELD OF THE INVENTION

This invention relates to a document reproduction apparatus and in particular to a simple and inexpensive high-capacity output catch tray for document production devices such as copiers, printers and fax machines.

BACKGROUND OF THE INVENTION

A. High Capacity Output Stacking Trays

In the prior art of output trays there has generally been an association of large, complex and expensive high volume copiers with similarly large, complex and expensive high capacity output collecting devices such as elevator trays, collators, sorters, vertically repositionable sheet output ports, and "mailbox" systems. In part this is because high volume copiers often must be capable of being coupled to subsequent machines in a production line, requiring that the top of the output stack be maintained at a relatively precise elevation for pickup by the next machine in the production line. However, where subsequent processing is not necessary there has previously been no simple, inexpensive, high capacity output stacking tray system available as a final station for such high volume copiers which did not suffer from various drawbacks addressed by the present invention.

Similarly, there has been an association of smaller, slower, and less expensive copiers with small, fixed, limited capacity output trays. High capacity output trays or systems with elevators or multiple trays generally either been unavailable for such smaller machines, or are too expensive to be suitable for the typical uses of such machines.

In all types of document production machines such as copiers, printers and fax machines, but particularly copiers for high speed, high volume production runs, the production of sheets by the copier can often exceed the capacity of presently available output catch tray systems. High capacity output trays, often referred to in the art as "stackers," are particularly desirable for the collected output of high speed or plural job batching copiers or printers. High capacity stackers are also desirable for the accumulated output of unattended plural user (networked) copiers and printers, of any speed.

Further by way of background on sheet stacking difficulties in general, outputted sheets are usually ejected into an output tray from above one side thereof. Normal output stacking is by ejecting sheets or sets of sheets from above one side of the top sheet of the stack of sheets onto which that additional ejected sheet or set of sheets must also stack. Typically, sheets or sets are ejected generally horizontally (or slightly uphill initially) and continue to move horizontally primarily by inertia. That is, sheets or sets in the process of being stacked are not typically effectively controlled or guided once they are released into the output tray. The sheets or sets fall by gravity into the tray to settle onto the top of the stack. However, such settling is resisted by the relatively high air resistance of the sheet or set to movement in that direction. Yet, for high volume copiers stacking must be done at high speed, so a long settling time is undesirable. Thus, a long drop onto the stack is undesirable.

Stacking is made even more difficult where there are variations in thickness, material, weight and condition (such as curls) of the sheets. Different sizes or types of sheets, such as tabbed or cover sheets or Z-folded or other inserts, may even be intermixed in the stack. The ejection trajectory and stacking should thus accommodate the varying aerodynamic characteristics of such various rapidly moving sheets or sets. A fast moving sheet or set can act as a variable airfoil to aerodynamically affect the rise or fall of the lead edge of the sheet as it is ejected. This airfoil effect can be strongly affected by curls induced in the sheet, by fusing, color printing, etc. Therefore, an upward trajectory output angle and substantial release height is often provided, well above the top of the stack. Otherwise, the lead edge of the entering document can catch or snub on the top of the stack already in the output tray, and curl over, causing a serious jam condition. However, setting too high a document ejection level to accommodate all these possible stacking problems greatly increases the settling time for all sheets or sets and creates other potential problems, such as scattering.

Scatter within a stack causes at least four problems. First, if copier has a sets offsetting feature, intended to provide job set separations or distinctions, scatter within a stack makes such set distinction more difficult. Second, misaligned sheets or sets tend to incur damage such as bending, folding, abrasion or tearing of sheet edges out of alignment with the overall stack edge. Third, a substantial stack within which individual sheets are not well aligned to each other is more difficult for an operator to grasp and remove from the stacker. Fourth, a misaligned stack is not easily loaded into a box or other transporting container of corresponding dimensions.

For the above listed reasons, it may be seen that the top of stack elevation should be maintained within a desired range. A tray elevator or vertically repositionable sheet output port is therefore normally provided to maintain a relatively constant relationship of sheet output elevation to top of stack elevation for high capacity output trays.

Numerous means for dealing with various such general problems of sheet stacking are taught in U.S. Pat. No. 4,385,758, U.S. Pat. No. 4,469,319, U.S. Pat. No. 5,005,821, U.S. Pat. No. 5,014,976, U.S. Pat. No. 5,014,977, U.S. Pat. No. 5,033,731, and art therein. Sheet "knock down" or settling assistance systems are known, but add cost and complexity and can undesirably prematurely deflect down the lead edge of the ejected sheet. Also, such "knock down" systems can interfere with sheet stack removal or loading and can be damaged thereby. Also, stacking systems should desirably provide relatively "open" trays, which will not interfere with open operator access to the output stacking tray or bin, for ease of removal of the sheet stack therein.

Many attempts have been made in the prior art to provide high capacity sheet stacking output trays. Among these are: U.S. Pat. No. 5,609,333 (describing a sheet stack height control system); U.S. Pat. No. 5,318,401 (describing a stacking tray system with nonvertically receding elevator yielding square stacks); U.S. Pat. No. 5,346,203 (describing a high capacity sheet stacking system with variable height input and stacking registration); U.S. Pat. No. 4,329,046 (describing a method for operating a reproduction machine with unlimited catch tray for multimode operation); U.S.

Pat. No. 4,141,546 (describing a mini-collator/sorter); U.S. Pat. No. 4,012,032 (describing a sheet handling system with a receiving tray for use in non-collate mode and a plurality of collator bins for operating in collator mode); U.S. Pat. No. 4,026,543 (describing a control system using a copy count, a tangent copy count, and a document tracing indicator to provide automatic control for copy overflows); U.S. Pat. No. 4,134,581 (describing a system having multiple collator bins treated as one virtual bin.)

In these systems there are generally two approaches to increasing output catch tray capacity. The first approach uses multiple receipt trays, bins or mailboxes (for simplicity, collectively referred to as "trays). The trays may be vertically or horizontally repositionable relative to a fixed output port, or the copier output port may be vertically or horizontally repositionable relative to a fixed tray or trays, or some combination of movable trays and moveable output port may be employed. However, although though multiple trays are in use, the individual trays generally have limited capacities requiring either additional control for tray switching, system shutdown or additional operator intervention.

In the second approach a single large output catch tray is used, but relatively powerful, complicated and expensive elevator mechanisms are required either to lower the catch tray or raise the copier output port as the stack grows in order to keep the top of the stack within an acceptable range below the sheet output port. As far as is presently known, prior art does not include the combination of a single large output catch tray with a vertically repositionable output port.

Other systems such as U.S. Pat. No. 3,871,643 teach a sorter system having two sorter sections. In particular, the control switches from one section to the next to continue a copying job. Also, if the bins in both sections of the sorter contain copy sheets, and the job requirement has not been completed, upon removal of the copy sheets in one of the sections, the reproduction machine will resume operation after having been temporarily halted.

The addition of multiple bins and trays, catch trays with elevator mechanism, or vertically repositionable copier output port increases the complexity of the components for copiers and their controls, with a corresponding decrease in expected reliability and increase in cost. It would therefore be desirable to provide a high capacity output catch tray for document production machines such as photocopiers, printers and fax machines having a minimum number of receiving trays and/or complex mechanisms and yet be able to handle high volume requirements with minimum operator intervention. Due to the lack of such a device, it is not unknown in the prior art to use stacks of cardboard boxes as cheap, high capacity output "trays."

B. Inclined Output Trays

For better stacking alignment to obtain neat, square and even-sided stacks, as is known in the art, it is preferable to output sheets or sets sequentially onto an inclined surface. Initially this is the inclined surface of the empty output tray, and then it is the correspondingly inclined upper surface of the sheet or set previously stacked thereon. If the output tray surface is upwardly inclined away from the copier output port into the tray, this is known in the art as "uphill" stacking. It is called "downhill" stacking if the output tray slopes downwardly away from the copier output port. There are many advantages to using either "uphill" or "downhill" stacking, either for stacking per se, or for stacking in a compiler for stapling or other binding or finishing. It allows different sizes of sheets to be stacked using the same paper path and the same tray system, using gravity assisted stacking against a simple inboard or outboard alignment surface, and is therefore relatively less expensive than more complicated active stacking registration or alignment systems, such as those requiring scullers, flappers, tampers, joggers, etc.

"Uphill" stacking desirably lends itself to stacking alignment at an inboard side of the output tray, that is, at the side adjacent the copier. It automatically slows down the ejected sheets, due to their initial "uphill" movement. The sheets then reverse their movement to slide back down against an upstanding wall or edge adjacent to but underlying the output port. Incoming sheets thus do not get caught on the edge of the stack in the tray, so long as subsequent sheets or sets enter above the top of the stack, which of course grows in length/height as the copy job progresses.

Prior art does not provide for a high capacity single output tray which can quickly and easily be configured to provide uphill, horizontal or downhill output stacking without the use of a tray elevator or vertically repositionable sheet output port.

C. Stack Edge Alignment

It is known in the art to provide a stacking system with an output tray elevator. The top of a stack in the output tray is maintained at a suitable height for such stacking, by the output tray and all its contents being moved downward as the stack accumulates, so that the top of the stack remains in the same general relative position below the copier output port.

In prior art, the stacking alignment surface is normally a fixed vertical surface which does not move relative to the copier and its output port, and not an integral upstanding side of the tray itself, as in a sorter bin or other conventional stacking tray. That is, the alignment surface against which the ejected sheets or sets are aligned is typically the vertical surface of the side of the machine or the stacking tray elevator itself, against which the sheets or sets may align as they stack.

In part, such a fixed alignment surface addresses the problem that if, instead, a conventional alignment side wall integral (and substantially perpendicular to) the stacking tray were provided (moving therewith), that alignment wall require a height equal to the full elevator travel range of the output tray. Otherwise, sheets or sets stacked higher than that alignment wall would slide off the stack. In the empty, fully raised position of such an output tray, such a fixed height alignment side wall would unacceptably extend well above the top of the machine, and/or block the sheet entrance to the tray if located on that side of the tray for "uphill" stacking.

Also, with such an output tray designed for high capacity stacking, the first incoming sheets would be required to drop a substantial distance before coming to rest on the top of the stack or tray. This large drop distance tends to increase the number of stacking problems noted above, such as sheets or sets coming to rest in an orientation other than flat against the top of the stack, and/or substantial scatter within the stack.

However, previous systems with fixed alignment surfaces suffer from various drawbacks. Since the edges of the sheets in the stack move relative to the alignment surface, friction of the sheet edges against the alignment surface lifts the sheet edges relative to the downward motion of the output tray, abrading the sheet edges and disturbing the stack so that is less flat, neat and square. This phenomenon is known in the art as "creep." With the extended use experienced by high volume copiers, over time, the friction also causes wear on the alignment surface so that it may become less smooth, exacerbating the problems of lift and creep. Fixed alignment surfaces must also be relatively long to provide high capacity and are therefore relatively bulky.

One previous attempt to deal with the problem of fixed alignment surfaces can be seen in U.S. Pat. No. 5,346,203, in which a variable height stack registration and edge alignment system is provided by way of numerous small belt-like flexible sheets which unroll upward corresponding to upward movement of a vertically repositionable sheet output port. However, as with previous tray elevator systems, this system is subject to the drawbacks of complexity, expense, and limited inter-connectivity; even more so in that it is associated with multiple output tray and/or mailbox systems.

It is therefore desirable to provide a simple, relatively smooth, variable length stack alignment and edge alignment system which corresponds directly and automatically to the output tray height and requires no external power source or control system.

To recapitulate, the limitations of the prior art of high capacity output trays are substantial. A simple fixed high capacity output tray without a vertically repositionable sheet output port is impractical because it requires either a high fixed side wall or that the output tray be very deep, so that ejected sheets or sets would have too far to drop and be subject to the abovementioned problems of scatter, disorientation, buckling, folding, etc. Vertically repositionable copier output ports, output tray elevators, multiple trays/bins/mailboxes are all relatively complex and high maintenance, require external power sources and controls, and are correspondingly expensive both initially and over time.

The present invention provides a simple, high capacity, adjustable, sheet stacking output tray suitable for connection to both large, high volume copiers and to smaller, less expensive ones, which is capable of automatically maintaining the top of stack height within an acceptable range relative to the sheet output port, without external power source or control, where precise stack height control is not required. The various adjustments in output tray angle, stack angle, effective spring rate, total weight capacity, and total stack height permitted by the invention allow a user to customize and optimize the invention for numerous applications. The invention thus uniquely provides for maximum upgrade-ability, downgrade-ability and compatibility between various sizes, types and brands of document production devices.

SUMMARY OF THE INVENTION

Briefly, the present invention is concerned with a simple, inexpensive high capacity output catch tray. The disclosed output tray automatically increases in capacity as the stack of copies in it accumulates, without external power source or control, while maintaining a relatively constant elevation relative to the copier output port, and automatically returns to its original position when partially or completely unloaded.

The invention achieves these advantages by the use of trampoline-type arrangement that suspends a stack support platform by springs around its perimeter from a frame removably attached to the copier. As copies accumulate on the platform the weight of the copies causes the springs stretch and increases the capacity of the output tray. The springs act as energy-storing biasing elements which return the platform to its unloaded position when the stack of copies is removed from the tray, and may also act as variable length alignment surfaces to keep the accumulating stack neat and square. Preferably the springs have a relatively smooth outer surface such as is provided by telescoping cylindrical sleeves around metallic coil springs, elastic cords or bands, or bungee cords, to keep the sides of the stack straight and prevent the sheets from binding or rubbing as the stack increases in length, thereby minimizing lift or creep of the sheets relative to the platform and alignment surface, but other commonly known biasing devices such as weights and pulleys, could be used alone or in combination with springs.

The invention provides improved output stacking of multiple printed sheets, such as multiple sets or jobs of flimsy copy sheets sequentially outputted by a copier, with overall stack alignment for subsequent handling, particularly for large stacks, at relatively low cost, and without sacrificing desired stacking and alignment orientations. Further so disclosed is a stacking system with a variable length alignment surface coupled to a vertically movable stack support platform.

The invention has particular utility and application for high capacity stacking of pre-collated copy output sheet sets from a copier, which may include a compiler and finisher, where such output may require stacking relatively large numbers of completed copies in a relatively high stack. Such stacked copies may be individual sheets or sets which may be unfinished, or may be stapled, glued, bound, or otherwise finished and/or offset.

The invention further provides a high capacity output tray for stacking substantial quantities of the output from a copier on a stack support platform optionally providing an inclined stacking surface at a substantial angle from the horizontal for receiving and aligning sheets against an upright stack edge alignment surface. Here, with little or no relative movement between the alignment surface and the stack edge, this stack edge alignment surface is automatically varied in length below the copier output port and above the stack support platform in coordination with the change in stack length/height supported by the platform.

The invention overcomes the above and other problems and limitations of prior art, without requiring an externally powered tray elevator or variable height output port, yet without sacrificing the desired output and stacking positions for the ejected sheets or sets.

The copier may operate in a single mode producing simple stacks, or may operate in multiple modes with stacks, unstapled sets and/or stapled sets, the sets and stacks being offset in the catch tray. With the addition of a simple detector, the copier can be made to temporarily halt when the top of the stack reaches a specified height relative to the sheet output port to avoid spilling or jamming, then resume operation and continue to do so as the output tray is emptied until the job in process is either completed or canceled.

As to specific hardware components which may be used with the subject apparatus, or alternatives, it will be appreciated that, as is normally the case, various suitable such specific hardware components are known per se in other apparatus or applications, including the cited references and commercial applications thereof.

BRIEF DESCRIPTION OF THE DRAWINGS

The above-mentioned objects and features of the present invention can be more clearly understood from the following detailed description considered in conjunction with the following drawings, in which the same reference numerals denote the same elements throughout, and in which.

Figure 1A:
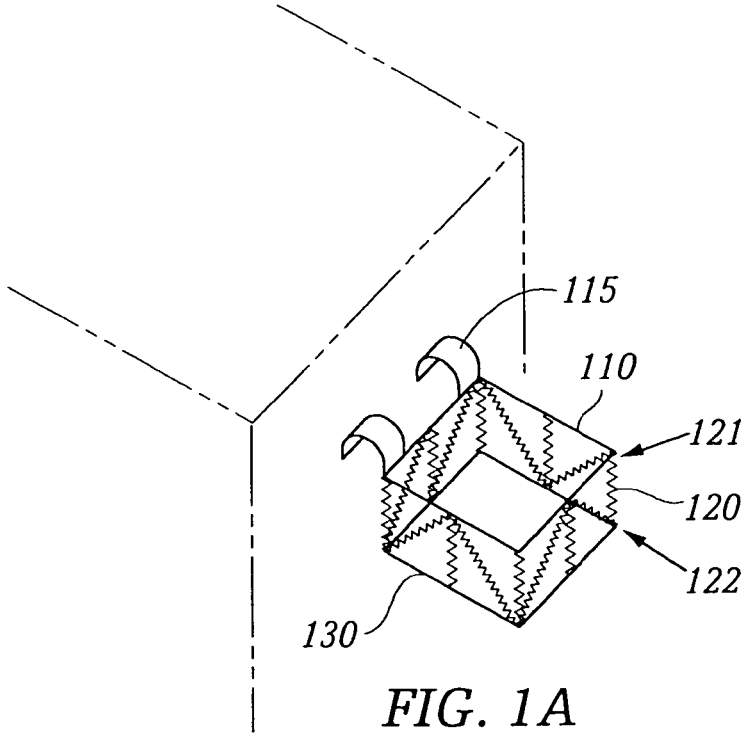
FIG. 1A is an isometric view of a simple "tampoline-style" high capacity output tray with springs configured to stack sheets vertically.
Figure 1B:
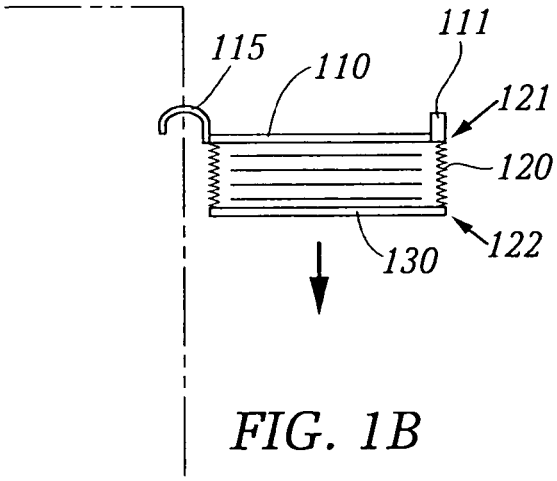
FIG. 1B is a cutaway side view of the same simple "trampoline-style" high capacity stacking output tray, showing a relatively small stack of outputted sheets stacked vertically.
Figure 1C:
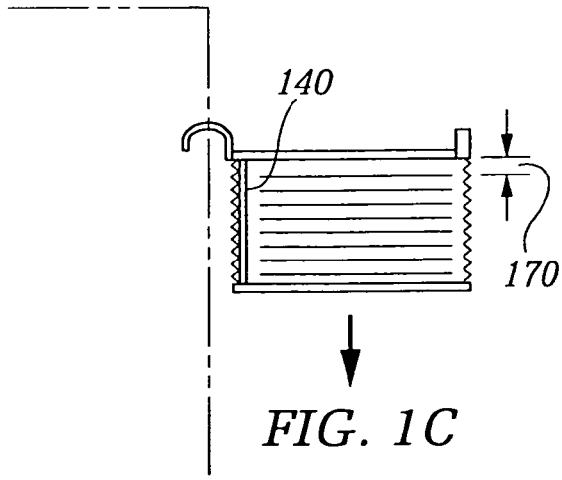
FIG. 1C is a cutaway side view of the same simple "trampoline-style" high capacity stacking output tray, showing a relatively large stack of outputted sheets which has displaced the stack support platform vertically downward while maintaining the top of stack elevation within an acceptable range relative to the copier output port.
Figure 1D:
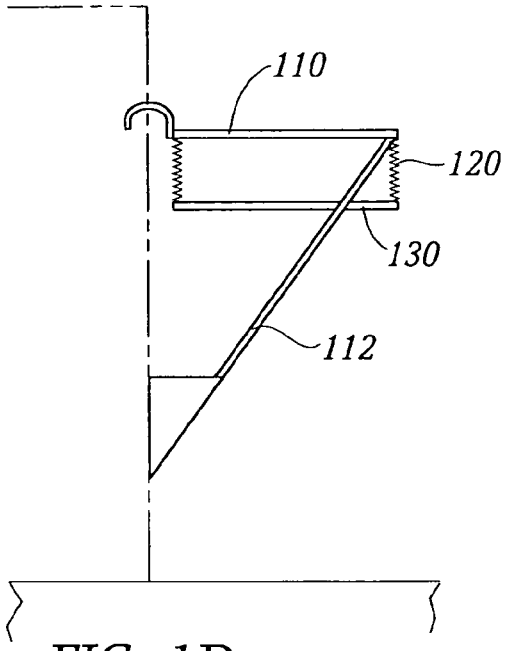
FIG. 1D is a side view of the same simple "trampoline-style" high capacity stacking output tray, showing an angled brace from the frame to the side of the document production machine for supporting the weight of large stacks of outputted sheets.

The present invention is not limited to the specific embodiments illustrated herein. The specific exemplary embodiments disclosed show a high-capacity stacking output tray that moves vertically downward, with either a flat or an inclined stacking surface at a selected stacking angle to the horizontal. With the addition of relatively simple angle adjustment devices such as variable length braces or wedges attached to the frame, it is possible to obtain substantially non-vertical downward movement of the output tray while maintaining the output tray surface at substantially a right angle to the direction of movement, thereby optimizing the alignment and square stacking capacity of the system.

DETAILED DESCRIPTION OF THE INVENTION

High Capacity Stacking Output Catch Tray

FIG. 1 shows a simple "trampoline-style" high capacity stacking output catch tray 100 with springs as biasing elements 120 connecting a frame 110 to a stack support platform 130, wherein the springs 120 are configured to catch and accumulate a vertical stack of sheets or sets output by a document production machine such as a copier, printer, or fax machine. According to this embodiment, the frame 110 defines a rectangular opening somewhat larger than the approximate size of the sheets to be caught and stacked. Connected to or made as part of the frame 110 are coupling devices known in the art as hooks 115 used to couple the frame 110 to the copier. The springs 120 connect the frame 110 to the stack support platform 130, the proximal ends 121 of the springs 120 being coupled to the frame 110 and the distal ends 122 of the springs 120 being coupled to and about the perimeter of a rectangular stack support platform 130 of approximately the size of the sheets to be stacked. The stack support platform 130 is thereby suspended from the frame 110 by means of the springs 120 and is free to move downward in an approximately vertical direction in response to the weight of an accumulating stack of sheets or sets output by the copier.

The rectangular dimensions of the frame 110 and stack support platform 130 may be varied, according to the dimensions of the sheets to be stacked, where relatively precise alignment of the stack edge is sought. Alternatively, where less precise alignment is required, a single large tray may suffice for all of the sizes of paper or documents which a particular copier is capable of producing. As a further alternative, a tray can be dimensioned to closely fit the stack in one direction but be relatively looser in another, for instance to allow for lateral offsetting of sets or jobs. As an additional further alternative, the frame 110 may be constructed in such a manner as to allow the lengths of its sides to be adjusted in the field by an operator, so that a single output tray 100 can be configured to define a plurality of differently dimensioned rectangles, according to the precise dimensions of the sheets to be stacked and other factors such as offsetting. The same may be provided with respect to the stack support platform 130.

In the preferred embodiments shown, the springs 120 are arranged so as to provide triangulation and lateral stability to the stack support platform 130, although the springs 120 could be configured so as to hang straight down or in some other arrangement. Additionally, one or more dampening devices in the nature of shock absorbers may be provided to further reduce swaying and resonant motion of the stack in response to cyclic rhythms or movements induced by operation of the copier.

As sheets or sets are ejected from the output port of the copier, they move across the top of the frame 110 until striking the opposite side of the frame 110, whereupon the sideways movement of the ejected sheet is stopped above the rectangular opening defined by the frame 110. The sheet or set then drops down through the rectangular opening of the frame 110, initially onto the top of the stack support platform 130 and subsequently onto the top of the stack accumulating in the output tray 100. When or before the output tray 100 reaches maximum capacity it is partially or completely emptied by an operator, reducing or eliminating the weight of the stack and allowing the springs 120 to reposition the stack support platform 130 upward to maintain either the unloaded stack support platform 130 or the top of the stack at an elevation within an acceptable range 170 relative to the elevation of the copier output port.

Preferably, one or more portions of the frame 110 on the side opposite the copier output port are higher than the output port to provide a backstop 111, so that sheets ejected at an angle substantially upward of horizontal will not fly over the frame 110 but will instead strike the backstop 111 and be captured.

Although the preferred embodiment depicted in the figures utilizes coiled metallic springs 120, numerous alternative energy-storing biasing elements may be provided such as springs of various configurations (coiled, leaf, torsion bar), elastic cords or bands made of rubber or elastomers, bungee cords, pressurized piston-cylinder devices, weights, and/or pulleys, alone or in combination with each other.

The springs 120 stretch in response to the weight of the stack accumulating on top of the stack support platform 130, allowing the stack support platform 130 to move downward and accommodate a stack of increasing length while maintaining the elevation of the top of the accumulating stack within a desirable range 170 relative to the copier output port. Since the weight of the stack increases linearly with the length of the stack, springs are particularly well-suited for use as biasing elements because they can easily be fashioned to have an inherently linearly increasing spring rate which is directly proportionate to the vertical linear movement of the stack support platform 130. Elastic cords or bands are specifically preferred for use as springs 120 because they can easily be fashioned with a relatively smooth exterior surface which is less likely than other types of springs to catch or bind the edges of sheets or stacks in the output tray 100.

In addition, the energy storing capacity of the springs 120 provides assistance to an operator when lifting sheets and/or stacks to remove them from the output tray 100.

Additionally, as the springs 120 stretch under the weight of the stack accumulating on top of the stack support platform 130, the springs 120 simultaneously act as variable length alignment surfaces 140 to produce a substantially aligned, straight stack, without the need for an additional component to provide an alignment surface. Although in this embodiment there is some relative motion between the surface of the springs 120 as they stretch, and the edges of sheets or sets accumulating in the stack, such relative motion is far less than would occur with an alignment surface which was fixed in relation to the movement of the stack support platform 130 as in prior art. By thus reducing relative motion between the alignment surface and the edges of sheets or sets accumulating in the output tray 100, friction and resulting binding, lifting and creeping of the stack edges is correspondingly reduced. The relatively smooth exterior surface of the preferred elastic cords or bands as springs 120 further reduces friction, binding, lifting and creeping, thereby additionally facilitating the aligning and straightening action of the springs 120.

In the preferred embodiment, sufficient capacity is provided by the output tray 100 so that constant monitoring or attention by an operator will not be required, and an interval of at least several minutes will elapse between occasions when an operator must reduce or remove the stack of sheets and/or sets accumulated in the output tray 100. However, if desired, one or more simple detectors and/or switches of types well known in the art can be added to provide signals to the copier or an operator to warn when maximum capacity of the output tray 100 is being approached or has been reached, and additionally if desired to cause the copier to cease output until the stack in the output tray 100 is removed or at least reduced.

In the preferred embodiment, variation in stack height capacity, weight capacity, and range of acceptable stack height relative to the copier output port, are accommodated by various combinations of springs 120 of different lengths and effective spring rates, and/or by additional mounting points on the frame 110 and stack support platform 130 to accommodate different numbers, sizes and arrangements of springs 120. If desired, further adjustability can be added by various devices known in the art, such as screw adjusters which move the mounting points of the springs 120 to vary their tension or pre-load.

Figure 1E:
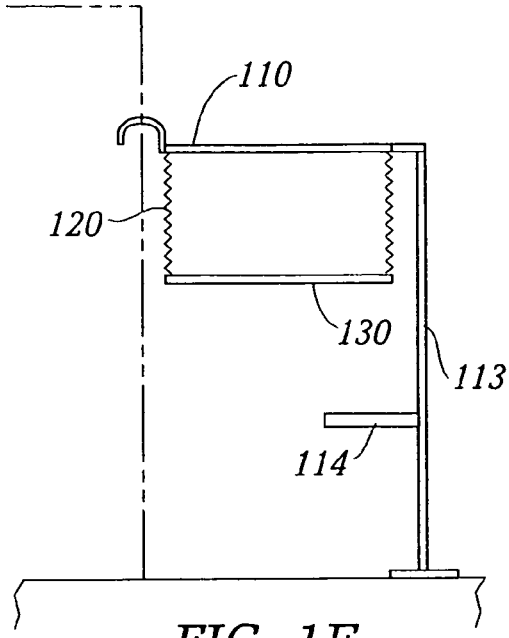
FIG. 1E is a side view of the same simple "trampoline-style" high capacity stacking output tray, showing a leg brace from the frame to the floor near the side of the document production machine for supporting the weight of relatively larger stacks of outputted sheets, and also showing a travel limiter to keep the stack support platform from moving too far down and over-extending the springs.
Figure 1F:
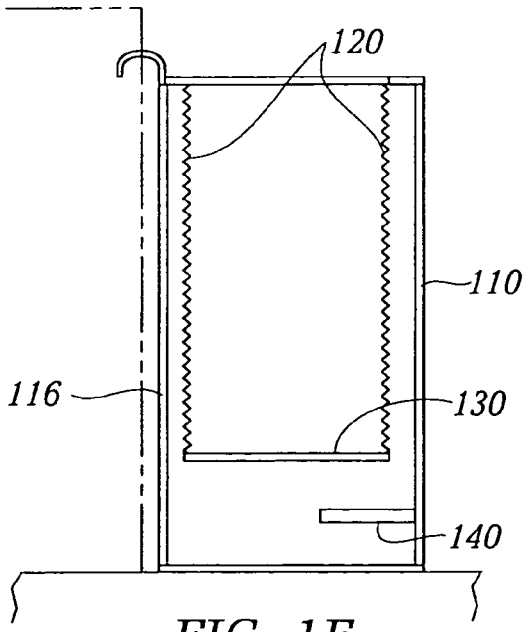
FIG. 1F is a side view of a simple "trampoline-style" high capacity stacking output tray with a large frame extending down to the floor on all sides of the stack, where part of the frame adjacent the document production machine also functions as a guide track to guide and stabilize the stack support platform as it moves downward, for supporting the weight of extremely large stacks of outputted sheets.

Depending on the desired size and capacity of the output tray 100, the frame 110 may be entirely supported by and suspended from the hooks 115 coupled to the copier, in combination with cantilevered forces against the side of the copier, friction and the moment of inertia generated by the weight of the output tray 100 and the stack it contains, as depicted in most of the figures. In an alternative embodiment depicted in FIG. 1D, additional weight bearing capacity for large stacks is provided by at least one angled brace 112 in the nature of a knee brace, the upper end of which is attached to the frame 110 and the lower end of which rests against the side of the copier. In a further alternative embodiment shown in FIG. 1E, increased additional weight bearing capacity is provided by a leg 113, the upper end of which is attached to the frame 110 and the lower end of which rests upon a floor or other horizontal surface adjacent the copier. In a final alternative embodiment as depicted in FIG. 1F, extreme weight bearing capacity is provided by enlarging the frame 110 so that its lower portion rests directly upon a floor or other horizontal surface adjacent the copier. To prevent the stack support platform 130 from traveling downward farther than may be desired, and thereby to limit the height and/or weight of the stack, an adjustable travel limiter 114 may be provided to contact the underside of the stack support platform 130 and prevent further downward movement of the stack support platform 130, as depicted in FIG. 1E and FIG. 1F.

As also depicted in FIG. 1F, a guide track 116 may be provided to guide and stabilize the stack platform 130 as it moves downward under the weight of an extremely large stack. In the preferred embodiment shown in FIG. 1F the guide track 116 is an integral part of a large frame 110, thereby minimizing complexity and number of parts.

Alternatively, the guide track 116 may be a detachable component available as an upgrade for frames 10 of various sizes.

The hooks 115 can be fashioned in various ways to provide maximum compatibility with different sizes, types, models and brands of copiers. Such ways include interchangeable frames with integral hooks of a desired configuration, or frames with detachable hooks which can be changed according to the configuration required for coupling to a particular copier.

Figure 2:
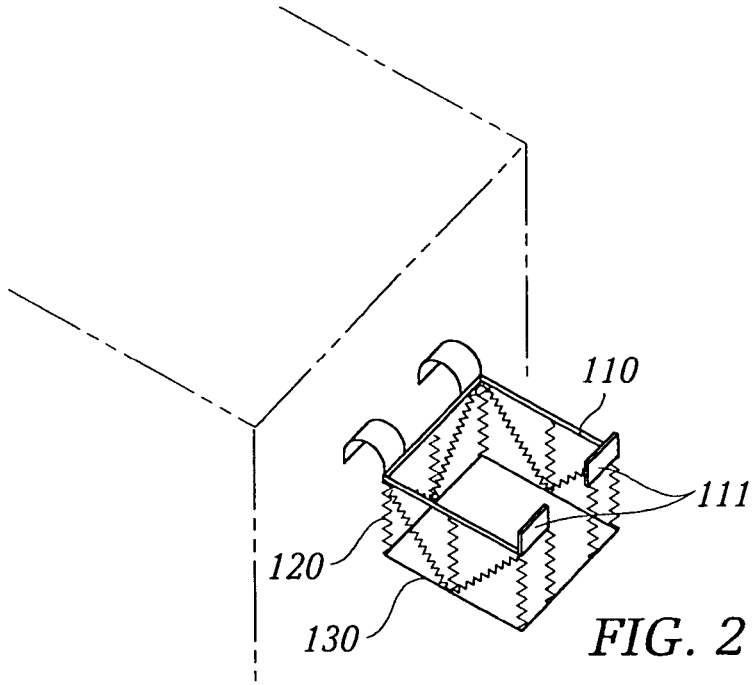
FIG. 2 shows an isometric view of an alternative simple "trampoline-style" high capacity stacking output tray with springs configured both to stack sheets vertically and to facilitate operator access for sheet removal.

Referring to FIG. 2, a preferred embodiment is shown of the frame 110 and springs 120 defining a lengthwise opening in one side of the output tray 100 to facilitate operator access for removal of sheets and/or sets from the output tray 100. The access opening shown in FIG. 2 is on the side of frame 110 opposite the sheet output port, but may be configured to be on any of the three sides not adjacent the copier.

Stack Support Platform Angle Adjusting Shim

Figure 3A:
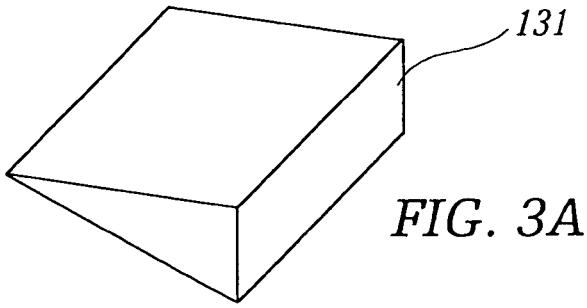
FIG. 3A shows an isometric view of a wedge-shaped shim which can be positioned on the output tray to obtain either "uphill" or "downhill" stacking, depending on its orientation, or removed entirely to obtain flat stacking.
Figure 3B:
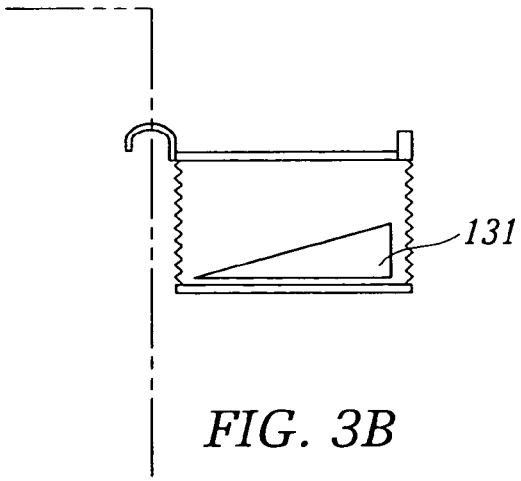
FIG. 3B shows uphill stacking accomplished by placing the low side of the shim toward the side of the output tray adjacent the copier and below the copier output port.
Figure 3C:
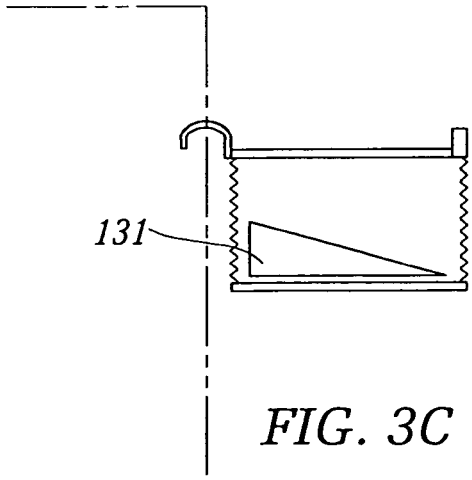
FIG. 3C shows downhill stacking accomplished by placing the high side of the shim toward the side of the output tray away from the copier and opposite the copier output port.

Referring to FIG. 3A, a simple wedge-shaped stack support platform angle adjusting shim 131 is shown. Viewed from above, the shim 131 is rectangular. The shim 131 fits through the frame 110 and rests on top of the stack support platform 130, and is otherwise dimensioned to be compatible with the size of sheets and/or sets to be accumulated in the output tray 100. Viewed from the front, one side of the shim 131 is substantially higher than the other so that when the shim 131 is placed on top of the stack support platform 130, either uphill or downhill stacking can be provided according to the orientation of the shim 131. If horizontal stacking is desired, the shim 131 is not employed and sheets or sets output by the copier rest directly on top of the stack support platform 130. As shown in FIG. 3B, uphill stacking is accomplished by placing the low side of the shim 131 towards the side of the output tray 100 adjacent the copier and below the copier output port. Downhill stacking is accomplished by reversing the orientation of the shim 131 so that the high side is below the output port and adjacent the copier, as shown in FIG. 3C. The shim 131 can be maintained in position by mechanical interlock with the springs 120 and their mounting points on the stack support platform 130, the weight of the stack resting on the shim 131, other fastening means commonly known in the art such as velcro, single- or double-sided tape, glue, screws, clips, etc., or various combinations thereof.

Variable Length Stack Edge Alignment Surface

Figure 4:
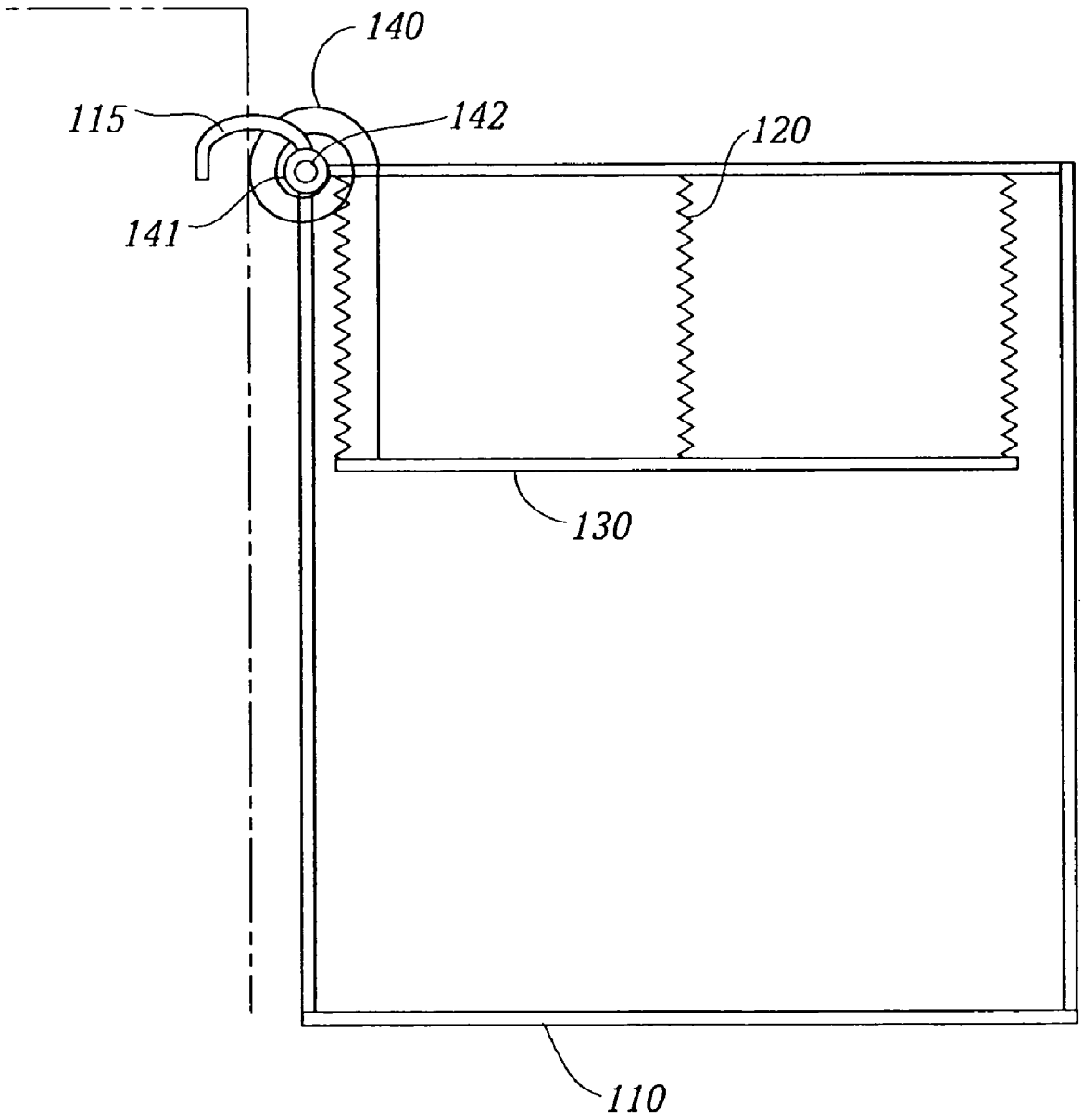
FIG. 4 shows a variable length stack edge alignment surface comprised of a wide belt which unrolls from the top of the output tray support frame in "windowshade" style to provide a smooth alignment surface which does not move relative to the stack.

FIG. 4 shows a side view of a variable length stack edge alignment surface 140 comprised of a belt-like flexible sheet or membrane which unrolls from the top of the output tray support frame 110 in "windowshade" style to provide a smooth alignment surface which does not move relative to the stack. Preferably a single stack edge alignment surface 140 is utilized, being approximately the width of the side of the frame 110 from which it unrolls, but in alternative embodiments two or more "belts" of narrower width may be employed. Although the material of the variable length stack alignment surface 140 is flexible enough to be rolled or curved, the number and arrangement of the springs 120 provide sufficient lateral and longitudinal support so that the material is not deformed beyond a range acceptable for a desired stack edge alignment tolerance.

As shown in FIG. 4, a single roll of such material for a variable length stack edge alignment surface 140 may be provided, on the side of the frame 110 adjacent the copier. The roll of flexible material for the stack edge alignment surface 140 is positioned sufficiently below the copier output port so as not to interfere with ejected sheets and/or sets, but not so low as to allow sheets and/or sets at the top of the stack to slide out of the output tray 100. In alternative embodiments, the roll may be located on any one side of the frame 110, or an additional roll or rolls may be located on any two or three or on all four sides of the frame 110. The length of the stack edge alignment surface 140 is determined according to the maximum desired stack height or output capacity of the output tray 100, and will vary according to particular applications.

In the preferred embodiment, one end of the variable length stack edge alignment surface 140 is attached to and wrapped around a roller 141 located adjacent a top edge of the frame 110, and the other end is attached to the stack support platform 130. As shown in FIG. 4, the "windowshade" style variable length stack edge alignment surface 140, unrolls and re-rolls onto the roller 141 according to the upward and downward movement of the stack support platform 130 responsive to the height and weight of the stack in the output tray 100. As again shown in FIG. 4, the spring 120 may be separate from a roller rewind spring 142 provided keep the variable length stack edge alignment surface 140 taught and to cause it to roll back around the roller 141 when the stack support platform 130 rises after being unloaded. Alternatively, the functionality of some of the springs 120 could be incorporated into a roller rewind spring 142 and some of the springs 120 eliminated.

Figure 5:
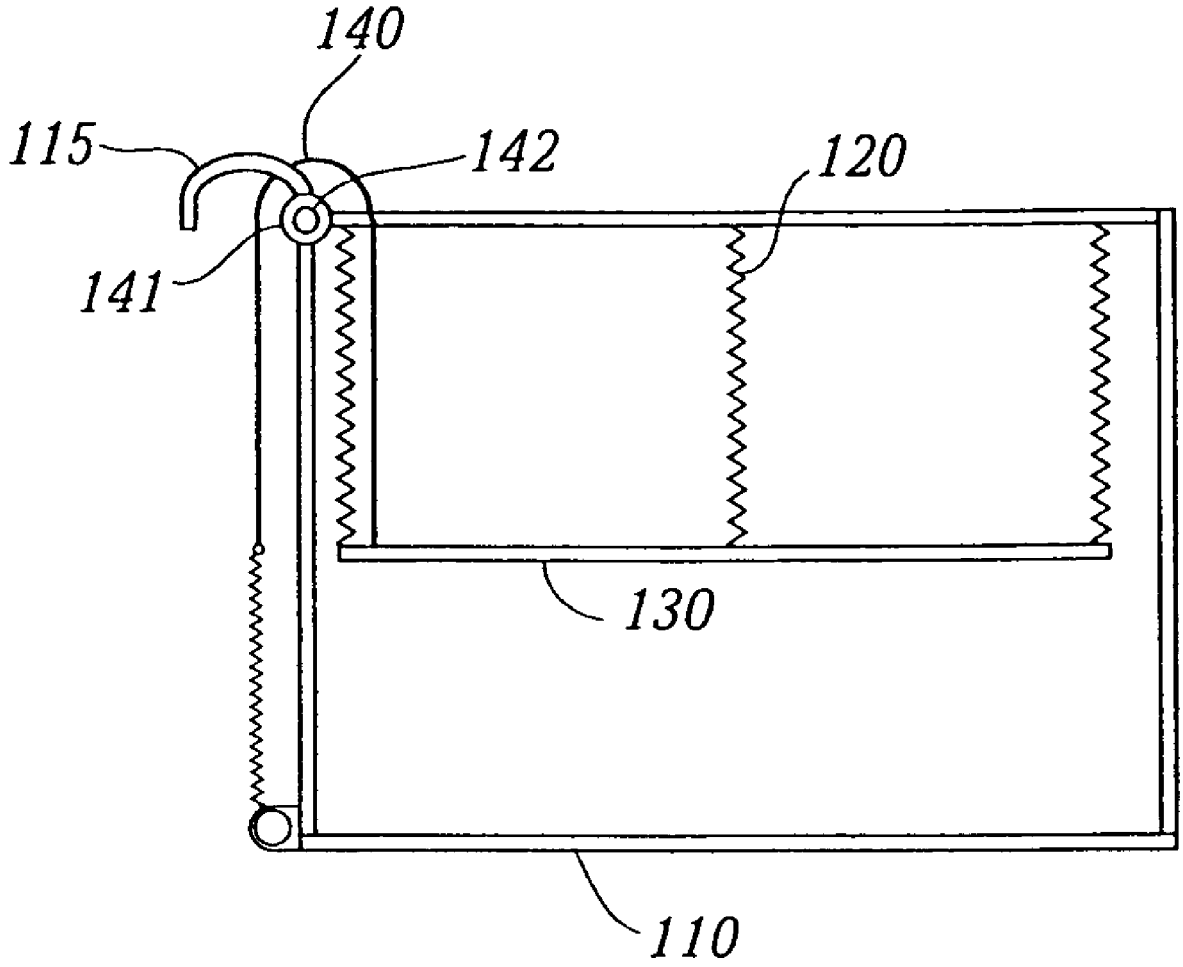
FIG. 5 shows an alternative variable length stack edge alignment surface comprised of a wide belt which moves over a roller at the top of the output tray support frame, where one end of the belt is attached to the stack support platform and the other end of the belt is attached to a spring connected to the frame.

FIG. 5 shows an alternative variable length stack edge alignment surface 140 that moves over a roller 141 located adjacent a top edge of the frame 110, where one end of the variable length stack edge alignment surface 140 is attached to the stack support platform 130 and the other end is attached to a spring 120, which in turn is attached to the frame 110.

Figure 6:
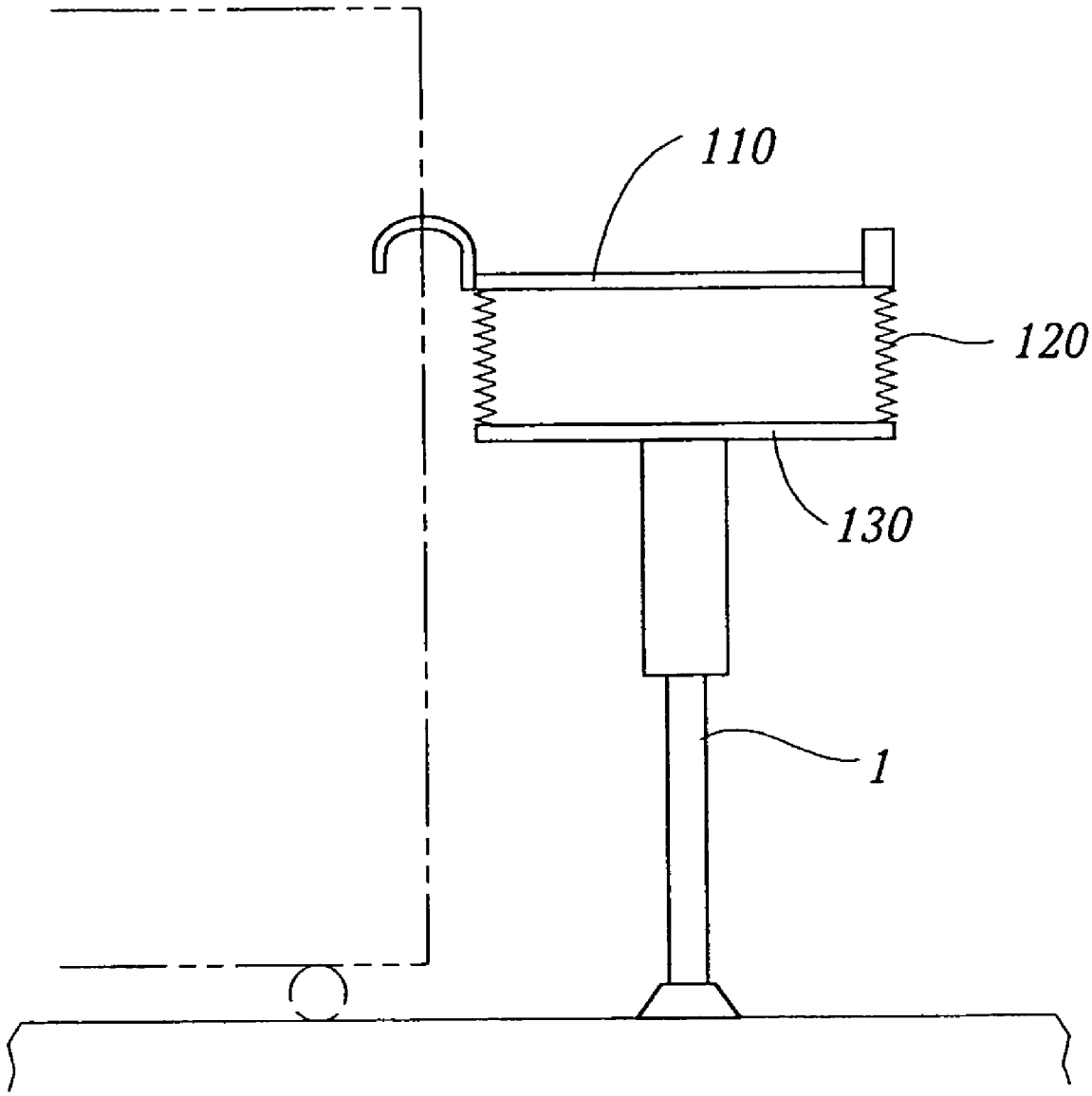
FIG. 6 shows an alternative simple, high capacity output tray where the biasing element is a telescoping cylinder that compresses as sheets are stacked on the stack support platform.

FIG. 6 shows an alternative simple, high capacity output tray 100 where the biasing element is a telescoping cylinder 124 that compress as sheets are stacked on the stack support platform 130. The top of upper end of the cylinder 124 contacts the underside of the stack support platform 130, while the lower end of the cylinder 124 rests on the floor. In a preferred embodiment, the cylinder 124 is sealed and capable of being pressurized either in the manner of a sealed "air spring" or hydraulically with the addition of a reservoir and pump. The cylinder 124 may be pre-pressurized or "pre-loaded" if desired, so that it will not begin to compress until a desired minimum stack weight is reached. Alternatively, the cylinder 124 may be essentially un-pressurized until compressed as sheets accumulate on the stack support platform 130.

GENERALITY OF THE INVENTION

The invention has general applicability to various fields of use relating to document production machines. In addition to copiers, the invention may be used for printers, whether stand-alone or networked, fax machines, or any other type of device which outputs sheets or sets of sheets of relatively thin, flexible material.

The foregoing merely illustrates the principles of this invention, and various modifications can be made by persons of ordinary skill in the art without departing from the scope and spirit of this invention.

The invention claimed is:

1. A high capacity output catch tray apparatus for accepting an output of a document production apparatus, the catch tray apparatus comprising:

a rectangular sheet support member, the sheet support member being the size of a sheet of paper and capable of supporting a plurality of the sheets from the output;

a frame element defining an opening the size of a sheet of paper, the frame element being capable of being coupled to the document production apparatus so that the sheet support member catches the output of the document production apparatus, and wherein the frame comprises a first frame element located adjacent to and beneath the document production machine output port, a second frame element opposite the first frame element, and a third frame element and a fourth frame element connecting the first frame element and the second frame element to define an approximately rectangular opening the size of a sheet of paper;

a first biasing element comprising a proximal biasing element end and a distal biasing element end, the proximal biasing end being coupled to the frame element and the distal biasing element end being coupled to the sheet support member, wherein the first biasing element is responsive to a weight of the plurality of sheets supported by the sheet support member such that the sheet support member is displaced downward effective to maintain an elevation of a top sheet of the plurality of sheets in a desired range relative to the output; and a variable length stack edge alignment surface comprising:

an approximately horizontal roller coupled to the first frame element below the output;

a flexible belt comprising a distal end coupled to the sheet support member and a proximal end coupled to the roller, wherein the flexible belt provides a relatively smooth surface against which edges of the plurality of sheets are aligned to form the plurality of sheets into a stack with relatively straight and smooth sides; and a second biasing element coupled to the roller and effective to keep the flexible belt taught while allowing the flexible belt to unroll and re-roll on the roller responsive to movement of the sheet support element.

2. The apparatus of claim 1, wherein the first biasing element and the second frame element are configured to include an opening to allow removal of some or all of the plurality of sheets by an operator.

3. A high capacity output catch tray apparatus for accepting an output of a document production apparatus, the catch tray apparatus comprising:

a rectangular sheet support member, the sheet support member being the size of a sheet of paper and capable of supporting a plurality of the sheets from the output;

a frame element defining an opening the size of a sheet of paper, the frame element being capable of being coupled to the document production apparatus so that the sheet support member catches the output of the document production apparatus, and wherein the frame comprises a first frame element located adjacent to and beneath the document production machine output port, a second frame element opposite the first frame element, and a third frame element and a fourth frame element connecting the first frame element and the second frame element to define an approximately rectangular opening the size of a sheet of paper;

a biasing element comprising a proximal biasing element end and a distal biasing element end, the proximal biasing end being coupled to the frame element and the distal biasing element end being coupled to the sheet support member, wherein the biasing element is responsive to a weight of the plurality of sheets supported by the sheet support member such that the sheet support member is displaced downward effective to maintain an elevation of a top sheet of the plurality of sheets in a desired range relative to the output; and a variable length stack edge alignment surface comprising:

an approximately horizontal roller coupled to the first frame element below the output;

a flexible belt comprising a distal end coupled to the sheet support member, wherein the flexible belt passes up and over the roller and is coupled at its proximal end to a recoil biasing element coupled to the frame;

wherein the recoil biasing element is effective to keep the flexible belt taught while allowing the flexible belt to roll back and forth over the roller responsive to movement of the sheet support element; and, wherein the flexible belt provides a relatively smooth surface against which edges of the plurality of sheets are aligned to form the plurality of sheets into a stack with relatively straight and smooth sides.

4. The apparatus of claim 3, wherein the first biasing element and the second frame element are configured to include an opening to allow removal of some or all of the plurality of sheets by an operator.

* * * * *